United States Patent [19]

Russwurm et al.

[11] Patent Number: 4,922,681

[45] Date of Patent: May 8, 1990

[54] HOT-ROLLED CONCRETE REINFORCING BAR, IN PARTICULAR REINFORCING RIBBED BAR

[75] Inventors: Dieter Russwurm, Puchheim; Dieter Jungwirth, Munich, both of Fed. Rep. of Germany

[73] Assignees: Dyckerhoff & Widmann AG, Fed. Rep. of Germany; Arbed S.A., Luxembourg

[21] Appl. No.: 242,729

[22] Filed: Sep. 9, 1988

[30] Foreign Application Priority Data

Nov. 9, 1987 [DE] Fed. Rep. of Germany ..... 37304909

[51] Int. Cl.[5] ..... E04C 5/03

[52] U.S. Cl. ..... 52/737; 52/740

[58] Field of Search ..... 52/737, 740, 738

[56] References Cited

U.S. PATENT DOCUMENTS 3,561,185 2/1971 Finsterwalder et al. ..... 52/737
4,056,911 11/1977 Tani ..... 52/740
4,229,501 10/1980 Kern ..... 52/737

FOREIGN PATENT DOCUMENTS 250972 10/1987 German Democratic Rep. ... 52/740

OTHER PUBLICATIONS

A Proposed Standard Deformed Bar for Reinforcing Concrete, 4/1942, pp. 35–63.

*Primary Examiner*—John E. Murtagh

[57] ABSTRACT

In a hot-rolled concrete reinforcing bar of which the ribs are arranged along a helical line and form portions of a thread for screwing on an anchoring or connecting body provided with a counter thread a rib form and rib arrangement improved as regards the dynamic stressability of the thread connection is proposed.

20 Claims, 1 Drawing Sheet

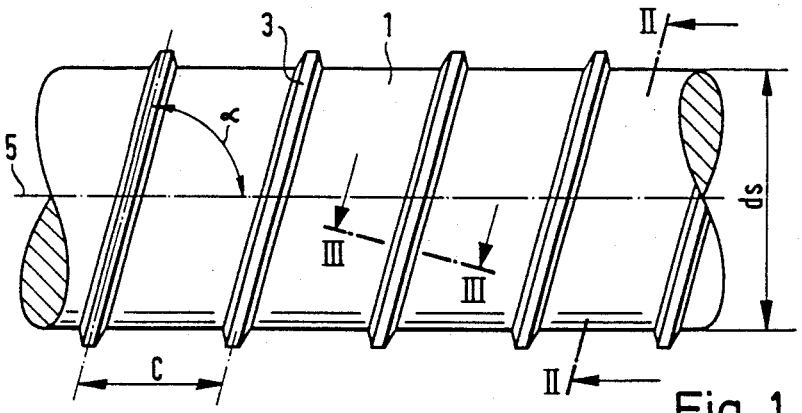
Fig. 1
Fig. 2
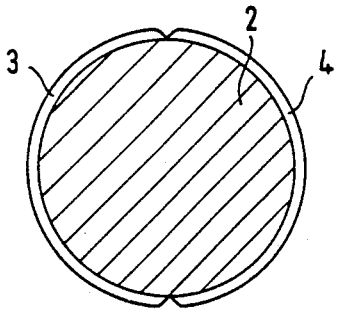
Fig. 3
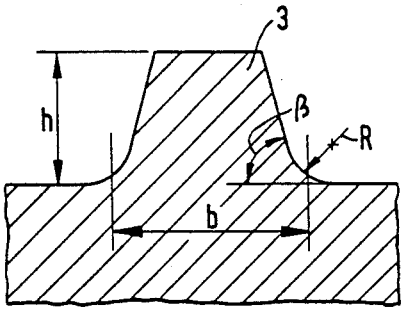
Fig. 4
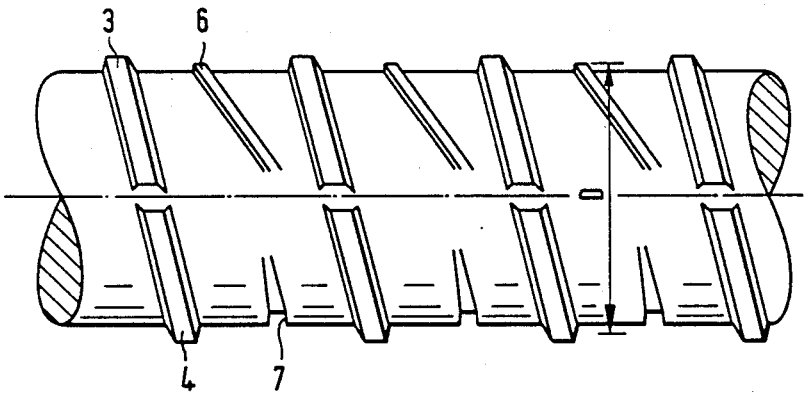

HOT-ROLLED CONCRETE REINFORCING BAR, IN PARTICULAR REINFORCING RIBBED BAR

BACKGROUND OF THE INVENTION

The invention relates to a hot-rolled concrete reinforcing bar, in particular a reinforcing ribbed bar.

Concrete reinforcing bars of this type are described for example in Beton- und Stahlbetonbau 2/1973, pages 25 to 35.

In screwable concrete reinforcing bars the ribs perform a double purpose. Firstly, they must ensure adequate bond in the concrete and secondly in their function as parts of a thread be able to transmit the necessary forces into an anchoring or connecting body into which an end of the concrete reinforcing bar is screwed.

With regard to these two functions in practice the concrete reinforcing bars known as GEWI-steel (registered trademark) have established themselves and are described in the aforementioned journal.

These concrete reinforcing bars have ribs relatively wide with respect to the bar diameter with relatively small spacing. The ratio of foot width of the rib to rib height of the reinforcing steel is about 3.7 and the rib spacing measured in the longitudinal direction is about 0.5 with respect to the nominal diameter. This corresponds to an inclination angle $\alpha$ of the ribs to the longitudinal axis of the concrete reinforcing bar of about 81.5°.

Because of this rib form and rib arrangement short thread connections are possible and due to the relatively large inclination angle $\alpha$ of the ribs to the longitudinal axis of the concrete reinforcing bar self-locking of the thread connection is ensured.

SUMMARY OF THE INVENTION

The problem underlying the invention is to provide a concrete reinforcing bar which is distinguished by an improved dynamic stressability. The notch effect caused by the thread ribs is to be reduced and thus the fatigue limit in the region of the thread connection increased.

Accordingly, the ribs are made substantially slimmer and have a smaller inclination angle to the longitudinal axis of the reinforcing steel than in the case of the known screwable concrete reinforcing bar. These measures not only reduce the notch effect and thus increase the dynamic stressability of the thread connection but also improve the filling degree in hot rolling and thus the manufacturability of the concrete reinforcing bar.

To prevent the smaller inclination angle of the ribs to the longitudinal axis of the concrete reinforcing bar causing the limit of self-locking for the thread connection to be exceeded, steps are taken to increase the coefficient of friction of the rib flanks of the concrete reinforcing bar used for the thread connection. Such steps may be implemented individually or in combination.

By the modification of the rib form and rib arrangement according to the invention, i.e. by reducing the ratio b/h and the inclination angle $\alpha$, the shearing area per unit length governing the load bearing behavior of the thread connection is however also reduced so that normally the length of the anchoring or connecting body must be increased if the same forces are to be transmitted.

Lengthening of the anchoring or connecting body, which is undesirable in particular with regard to the summating rolling tolerances in the rib spacings, can be avoided, i.e. for the same length in spite of reduced shearing area in the thread region equal magnitude or greater forces can be transmitted, if the shearing strength of the concrete reinforcing bar is increased in the rib region. This is done according to a further development of the invention in that a concrete reinforcing bar is used which in the edge and rib region has a strength increased compared with the core. Such concrete reinforcing bars have for example become known under the trade name Tempcore steels (registered trademark). Such steels are made in that on emerging from the last roll stand of a hot-rolling mill they are intensively cooled in the edge zone by a water cooling line so that in said zone a hard structure occurs and that the hardened edge zone after exit of the bar from the water cooling line is reheated by the hot content of the core zone. Steels of this type and methods for the production thereof are generally known and consequently a detailed description would be superfluous. Not only do they have a strength increased with respect to the core but also a coefficient of friction at their surface and thus in the rib region which is increased compared with other hot-rolled concrete reinforcing bars. Thus, as regards this property they are particularly suitable for the concrete reinforcing bar according to this invention.

Concrete reinforcing bars made from such steels and having the form and arrangement of the ribs according to the invention are also distinguished by improved ductility. The ductility of a concrete reinforcing bar is determined by the uniform elongation, the ratio of tensile strength to yield strength and the bond. With concrete reinforcing bars according to the invention without difficulty a uniform elongation $\geqq 6\%$, a ratio of tensile strength to yield strength $\geqq 1.1$ and a sufficient soft or mild bond assisted by the surface roughness of the bar can be implemented.

The reduction of the inclination angle of the ribs to the longitudinal axis of the reinforcing steel and a reduction of the ratio $h/d_s$, i.e. the rib height related to the bar diameter, also reduces the related or specific rib area. This can be counteracted in that the ribs are lengthened so that they extend in full height in each case almost over half the bar periphery and/or that the ribs are arranged along a two-flight helical line. These two steps also have the effect of increasing the shearing area per unit length, i.e. the loadability of the thread connection. The reduction of the related or specific rib area can however also be counteracted by providing auxiliary ribs or incisions between the ribs. At least the auxiliary ribs which have a position lying outside the helical line of the thread or are widened must have a rib height which is reduced to such an extent that the screwing on of the associated anchoring or connecting body is not obstructed thereby. The diameter of the cylindrical envelope of the auxiliary ribs must therefore be smaller than the internal diameter of the thread of the anchoring or connecting body to be screwed onto the concrete reinforcing bar.

Since the auxiliary ribs or incisions increasing the specific or related rib area, and thus the bond are not fixed in their position by the helical line of the thread they can additionally be used to designate the concrete reinforcing bar, i.e. since they do not impair the function of the thread of the thread ribs the auxiliary ribs or incisions can be employed possibly in conjunction with the thread ribs in the manner desired for the designation as regards steel type or supplier.

BRIEF DESCRIPTION OF THE DRAWING

The invention will be explained in detail with reference to two examples of embodiment with the aid of four Figures, wherein:

FIG. 1 is a length of a screwable concrete reinforcing bar in plan view,

FIG. 2 is a section II—II of FIG. 1,

FIG. 3 shows in an enlarged illustration the section III—III of FIG. 1, and FIG. 4 is a length of a concrete reinforcing bar with auxiliary ribs and incisions in side elevation.

DESCRIPTION OF THE PREFERRED EMBODIMENTS

The hot-rolled concrete reinforcing bar 1 illustrated in FIGS. 1 to 3 comprises a circular core cross-section 2 shown hatched in FIG. 2 and two rows lying opposite each other of ribs 3 and 4 which are arranged along a helical line and form portions of a thread for screwing on an anchoring or connecting body provided with a counter thread. The ribs 3 and 4 formed in the same manner are also designated hereinafter as thread ribs. They extend as shown in FIG. 2 in full height in each case almost over half the bar periphery.

The following quantities shown in FIGS. 1 to 3 serve to designate the rib form and rib arrangement:

b=foot width of the rib $d_5$=nominal diameter of the reinforcing steel h=rib height R=curvature radius at the rib foot in mm $\alpha$=inclination angle of the rib to the longitudinal axis 5 of the reinforcing steel in old degrees $\beta$=inclination angle of the rib flank in old degrees C=spacing of the ribs measured in the longitudinal direction of the concrete reinforcing bar.

The shearing area per unit length governing the loadability of the thread connection is defined by the foot width b, the length and the spacing C or inclination angle $\alpha$ of the ribs. Compared with known thread bars the foot width b of the rib is diminished. The resulting reduction of the shearing area is compensated partially by increasing the rib length and in addition also by increasing the strength of the reinforcing bar in the region of the edge zone, i.e. in the rib region. The increased strength in the rib region is achieved in that the hot-rolled steel on emerging from the last roll stand is intensively cooled in the edge zone by a water cooling line in such a manner that in said zone a hard structure is formed and the hardened edge zone after exit of the steel from the water cooling line is reheated by the heat content of the core zone. A concrete reinforcing bar made in this way is distinguished due to the scaling in the edge and rib region also by an increased coefficient of friction which is desirable with regard to self-locking of the thread.

Due to the rib form and rib arrangement the concrete reinforcing steel according to the invention is distinguished by an increased dynamic loadability so that it can be used with the usual anchoring and connecting bodies also in dynamically stressed components.

The concrete reinforcing bar illustrated in FIG. 4 differs from the concrete reinforcing bar illustrated in FIGS. 1 to 3 in that between the thread ribs 3 auxiliary ribs 6 are disposed and between the thread ribs 4 incisions or notches 7. These steps serve to improve the bond of the concrete reinforcing bar to the concrete. They may be necessary if with reduced inclination angle $\alpha$ of the thread ribs, i.e. with an increased pitch of the thread, the distance C between the thread ribs exceeds a specific amount and the related or specific rib area becomes too small. If it is not possible or not desired to adopt a two-flight (double) or multiflight thread and arrange the auxiliary ribs along the additional helical lines of such a thread, i.e. if as in the case illustrated the auxiliary ribs 6 have a position lying outside such a helical line, they must have a rib height reduced compared with the thread ribs 3 or 4 to such an extent that the screwing on of the associated anchoring or connecting body is not obstructed by the auxiliary ribs. The diameter D of the cylindrical envelope of the auxiliary ribs 6 must therefore be smaller than the internal diameter of the thread of the anchoring or connecting body to be screwed onto the concrete reinforcing bar. Instead of auxiliary ribs projections may also be employed having a form deviating from a rib form, such as burrs.

In the concrete reinforcing bar according to FIG. 4 in addition to auxiliary ribs 6 impressions or notches 7 are shown in order to illustrate two fundamental possibilities. Additional ribs only or incisions only may be provided at any desired points between thread ribs 3 and/or 4. This also provides the possibility of designating the screwable concrete reinforcing bar as regards steel type or supplier by the arrangement of the ribs or incisions. Thus, the rib arrangement shown in FIG. 4 designates the steel type Fe B 500 according to European standard 80–85.

EXAMPLE

A hot rolled ribbed reinforcing bar BSt 500/550 S ds =28 mm was produced in accordance with the Tempcore process from a steel having C =0.19% per weight Mn=1.04% per weight Si=0.24% per weight Cu≦0.20% per weight P=0.015% per weight S=0.01% per weight.

The ribbed bar had an almost circular cross section and two opposite rows of ribs of substantially trapezoidal cross section. The ribs were arranged along a double thread. The rib form and rib pattern was further characterized by the following parameters (as defined above)

b =4.5 mm ds =28 mm h =1.65 mm

R =1.8 mm $\alpha$=76 degree $\beta$=45 degree

C =11 mm h/ds =0.059 b/h =2.7

C/ds=0.4

Each of the ribs extended in full height over almost half the bar periphery, namely over 170 (old) degrees. Characteristic mechanical values of the ribbed bar determined by tests in accordance with DIN 488:

Re=568 N/mm$^2$

Rm=666 N/mm$^2$

A5=21.4%

Fatigue tests carried out in accordance with DIN 488 with a range of stress, 2oa=250 N/mm$^2$, maximum stress, Oo=325 N/mm$^2$, yielded no failure of the bars up to 3,5 Mio loading cycles.

Tensile tests on mechanical splices with a length of sleeve (connecting body of adjacent ends of two thread bars) of 2.47 =94 mm proved a resistance of the splice being over 1,2-times of the nominal yield force of the reinforcing bar.

Both the fatigue tests on the reinforcing bar and the tests with the mechanical splices yielded 10–20% superior values compared with those of the state of the art (Betonund Stahlbetonbau, 2/1973, pages 25 to 35).

We claim:

1. Hot-rolled concrete reinforcing bar (1), in particular reinforcing ribbed bar consisting of steel having a content of $0.10 \leqq C \leqq 0.27$ $0.40 \leqq Mn \leqq 1.40$ $Cu \leqq 0.80$, with circular or almost circular core cross-section (2) and two opposed rows of ribs (3,4) of substantially trapezoidal cross-section which are arranged along a helical line and form portions of a thread for screwing on an anchoring or connecting body provided with a counter thread and which with the definitions b=foot width of the rib $d_s$=nominal diameter of the reinforcing steel h=rib height R=curvature radius at the rib foot in mm $\alpha$=inclination of the rib with respect to the longitudinal axis of the reinforcing steel in old degrees $\beta$=inclination angle of the rib flank in old degrees, have a rib form and a rib arrangement which fulfills the following conditions $40° < \beta < 60°$ $1.0 < R < 3.0$ $0.04 \leqq h/d_s \leqq 0.06$ $1.5 \leqq b/h \leqq 3.3$ $60° < \alpha < 80°$ and which by scale formation by means of a quenching and reheat treatment from the rolling heat the coefficient of friction of the concrete reinforcing bar in the rib region is increased compared with the rolling state.

2. Concrete reinforcing bar according to claim 1, characterized in that in the rib region it has a frictional value ensuring self-locking.

3. Concrete reinforcing bar according to claim 1; characterized in that in the edge and rib region it has a strength increased compared with the core.

4. Concrete reinforcing bar according to claim 1, characterized in that the ribs (3, 4) are arranged along a two-flight helical line.

5. Concrete reinforcing bar according to claim 1, characterized in that the spacing C of the ribs (3, 4) measured in the longitudinal direction of the reinforcing bar satisfies the condition $0.38 < \mathbf{Cld}_s < 0.60$.

6. Concrete reinforcing bar according to claim 1, characterized in that the ribs (3, 4) extend in full height in each case over almost half the bar periphery.

7. Concrete reinforcing bar according to claim 1, characterized in that it has a uniform elongation $A_g < 6\%$.

8. Concrete reinforcing bar according to claim 1, characterized in that between the ribs (3, 6) impressions or incisions (7) are present.

9. Concrete reinforcing bar according to claim 1, characterized in that b/h of the ribs satisfies the condition $2.0 < b/h \leqq 3.0$.

10. Hot-rolled concrete reinforcing bar (1), in particular reinforcing ribbed bar, with circular or almost circular core cross-section (2) and two opposed rows of ribs (3, 4) of substantially trapezoidal cross-section which are arranged along a helical line and form portions of a thread for screwing on an anchoring or connecting body provided with a counter thread and which with the definitions b=foot width of the rib $d_s$=nominal diameter of the reinforcing steel h=rib height R=curvature radius at the rib foot in mm $\alpha$=inclination of the rib with respect to the longitudinal axis of the reinforcing steel in old degrees $\beta$=inclination angle of the rib flank in old degrees, have a rib form and rib arrangement which fulfills the following conditions $40°21\ \beta < 60°$ $1.0 < R < 3.0$ characterized in that $0.04 \leqq h/d_s \leqq 0.06$ $1.5 \leqq b/h \leqq 3.3$ $60° < \alpha < 80°$ and by mechanical and/or chemical treatment the coefficient of friction of the concrete reinforcing bar is increased in the rib region compared with the rolling state.

11. Concrete reinforcing bar according to claim 10, characterized in that in the rib region it has a frictional value ensuring self-locking.

12. Concrete reinforcing bar according to claim 10, characterized in that in the edge and rib region it has a strength increased compared with the core.

13. Concrete reinforcing bar according to claim 10, characterized in that the ribs (3,4) are arranged along a two-flight helical line.

14. Concrete reinforcing bar according to claim 10, characterized in that the spacing C of the ribs (3,4) measured in the longitudinal direction of the reinforcing bar satisfies the condition $0.38 \leqq C/d_s \leqq 0.60$.

15. Concrete reinforcing bar according to claim 10, characterized in that the ribs (3,4) extend in full height in each case over almost half the bar periphery.

16. Concrete reinforcing bar according to claim 10, characterized in that it has a uniform elongation $A_g \geqq 6\%$.

17. Concrete reinforcing bar according to claim 10, characterized in that between the ribs (3,6) impressions or incisions (7) are present.

18. Concrete reinforcing bar according to claim 10, characterized in that b/h of the ribs satisfies the condition $2.0 \leqq b/h \leqq 3.0$.

19. Hot-rolled concrete reinforcing bar according to claim 10, characterized in that the steel has a content of $0.10 \leqq C \leqq 0.27$ $0.40 \leqq Mn \leqq 1.40$ $Cu \leqq 0.80$.

20. Concrete reinforcing bar according to any one of claims 1 to 7, characterized in that between the ribs (3) projections or auxiliary ribs (6) are arranged of which at least those having a position lying outside the single-flight or multi-flight helical line or which are widened have a rib height which is reduced to such an extent that the screwing on of the associated anchoring or connecting body is not obstructed by the auxiliary ribs.

* * * * *